United States Patent [19]

Carstedt

[11] 4,060,236

[45] Nov. 29, 1977

[54] AUTOMATIC SHEET DECURLER

[76] Inventor: Howard B. Carstedt, Rte. 1, Box 208, Loretto, Minn. 55357

[21] Appl. No.: 657,874

[22] Filed: Feb. 13, 1976

Related U.S. Application Data

[63] Continuation of Ser. No. 358,981, May 10, 1973, abandoned.

[51] Int. Cl.[2] ..... B65H 29/70; B65H 29/04

[52] U.S. Cl. ..... 271/183; 72/54; 72/160; 271/188; 271/195; 271/204

[58] Field of Search ..... 271/183, 182, 188, 204, 271/205, 206, 240, 209, 248, 195; 72/54, 160

[56] References Cited

U.S. PATENT DOCUMENTS

| | | | |
|---|---|---|---|
| 1,709,096 | 4/1929 | Reinhold | 271/249 |
| 2,106,199 | 1/1938 | Wormser | 271/183 |
| 2,474,997 | 7/1949 | Wormser | 271/183 |
| 2,881,000 | 4/1959 | Kephart | 271/195 X |
| 3,076,492 | 2/1963 | Monks | 72/54 |
| 3,212,775 | 10/1965 | Taylor | 271/188 |
| 3,451,670 | 6/1969 | Staines | 271/183 |

FOREIGN PATENT DOCUMENTS

| | | | |
|---|---|---|---|
| 541,455 | 3/1956 | Italy | 271/248 |

*Primary Examiner*—Evon C. Blunk
*Assistant Examiner*—Bruce H. Stoner, Jr.
*Attorney, Agent, or Firm*—Williamson, Bains & Moore

[57] ABSTRACT

A method and apparatus for continuously bending or creasing sheet material as the material travels along a path. The invention creases and decurls the material; that is, compensates for a natural tendency to curl in the opposite direction, and serves as a drag on the trailing portion of the sheet material, thereby providing positive sheet control. It is characterized by an air pressure gradient which forces the material into a zone between a pair of parallel, spaced, elongated support surfaces as the material is drawn over the support surfaces.

6 Claims, 4 Drawing Figures

AUTOMATIC SHEET DECURLER

This is a continuation, of application Ser. No. 358,981, filed May 10, 1973, now abandoned.

BACKGROUND OF THE INVENTION

The invention resides in the field of sheet material processing including the graphic arts, paper making, and other fields which require the feeding or continuous, high-speed movement of sheet material. Most typically, the invention is applicable in a printing operation in which paper or other sheet material formed from fibrous particles is continuously fed and printed in a printing press.

In a continuous printing operation the paper is pulled by gripper bars along a circuitous path between and over cylinders which print the paper and deliver it in the conventional manner. The wetting (printing or coating) of one side of the paper and the curved path of travel of the sheet over the impression and other cylinders causes the sheet to curl about an axis spaced from the paper on the dry or unprinted side. In other words, the wet or printed side of the material is the convex side of the curl, and the dry or unprinted side is the concave side.

The curling of the paper causes problems of handling as the sheet is processed in the press and causes offset or print transfer problems at the delivery pile. The wet ink from the curled sheet is transferred to the unprinted side of the adjacent sheet above it. This problem does not occur when sheets are delivered flat due to the uniform floating of the upper sheet on the lower sheet.

Sheets delivered in a curled condition have a tendency to come to rest with their edges out of register with the edges of the adjacent sheets, thereby requiring increased shuffling or "jogging" of the sheets in the delivery pile to obtain a neat, registered stack. Thus, both the offset problem and need for increased "jogging" are caused by curled sheets and require slowing or stopping of the press for corrective action, which raises printing costs.

An additional shortcoming in the conventional printing operation is that the sheet material is pulled along a path by gripper bars which grip the leading edge of the sheet only, and the trailing edge is free and uncontrolled. Thus, there is no control or tension on the sheet, and operations such as slitting and trimming during the printing operation are difficult.

Prior art solutions to the curling problem have included bars, rollers or cylinders which engage the printed or wet side of the paper as the paper is pulled and bent around the bar, etc. While this method and apparatus decurls the sheet, it also smears the ink or other coating unless the printed or treated side is dry, a condition difficult or practically impossible to attain while the sheet is traveling through the press. Moreover, this prior art solution is not readily adjustable to compensate for variations in the speed of travel of the sheet material; variations in the properties, including thickness, of the sheet material; and variations in other conditions.

SUMMARY OF THE INVENTION

The present invention operates by engagement of the unprinted or dry side of the sheet; that is, the side opposite the newly printed or wet side. The sheet is positively decurled by continuous bending in a direction opposite to the direction of the natural tendency to curl without engagement of the printed or wet side. The continuous bending or creasing is brought about by engagement of the unprinted or dry side only, and substantial, sensitive and convenient adjustment of the degree of creasing or decurling is possible to compensate and adjust for varying conditions such as speed of travel of the sheet material, and thickness, stiffness and other properties of the sheet material.

The present invention also provides a drag on the trailing portion of the sheet, thus placing the sheet in tension between the gripper bars and the decurling apparatus, and increasing sheet control. The sheet may be slit, for example, by locating a blade between the gripper bar and the decurler, and it also may be trimmed in a similar manner, an operation not nearly as simple and convenient in the absence of tension on the sheet.

The present invention also provides a means for creasing the sheet longitudinally, an operation difficult to accomplish in prior art devices. For this purpose the decurler is oriented longitudinally rather than transversely with respect to the path of travel.

And finally the invention serves to clean the sheet material, removing particles which cling to the surface, and it provides a drying action. The pressure gradient explained more particularly below cleans the unprinted or dry side of the sheet by a vacuum-type action and drys and sweeps the printed or wet side by means of an air blast. These are secondary advantages and objects of the invention.

The invention is characterized by a pair of spaced, substantially-parallel, elongated support surfaces which in most applications extend transversely to the direction of travel of the sheet from one side edge of the sheet to the other. Means for creating a pressure gradient in a zone between the elongated support surfaces throughout the length of the support surfaces is provided. Means is also provided for drawing the sheet material over the support surfaces through the zone of the pressure gradient, to thereby force the sheet material, due to the pressure differential, into the zone between the spaced support surfaces and continuously crease or bend it as the sheet passes over the support surfaces.

The means for creating a pressure gradient may include a chamber communicating with ambient conditions in a zone between, offset from, and extending substantially parallel to the support surfaces located on the unprinted side of the sheet material, and means for evacuating the chamber. The pressure gradient may also be provided by means located on the printed side of the sheet material opposite the support surfaces for directing an air stream toward the sheet material between the support surfaces, or a combination of the foregoing may be used. In any case, the sheet material is forced into the zone between the elongated space support surfaces by the pressure gradient, thereby bending or creasing it in the desired direction.

The method of the present invention, apparent from the foregoing summary of the apparatus, is characterized by the steps of drawing the sheet material over a pair of spaced, substantially-parallel, elongated support surfaces, and simultaneously and continuously forcing the sheet material against the support surfaces and into a zone between and offset from the support surfaces by means of air pressure. The pressure gradient may be brought about by ambient pressure on the printed side of the sheet material and less than ambient pressure on the opposite side; it may be brought about by greater than ambient pressure on the printed side and ambient pressure on the unprinted side; or it may be brought about by greater than ambient pressure on the printed side and less than ambient pressure on the unprinted side. The pressure on the wet or printed side must simply be greater than the pressure on the unprinted or dry side.

BRIEF DESCRIPTION OF THE DRAWINGS

In FIG. 4 two typical alternate locations of the decurler unit are shown.

DESCRIPTION OF THE PREFERRED EMBODIMENT

Figure 1:
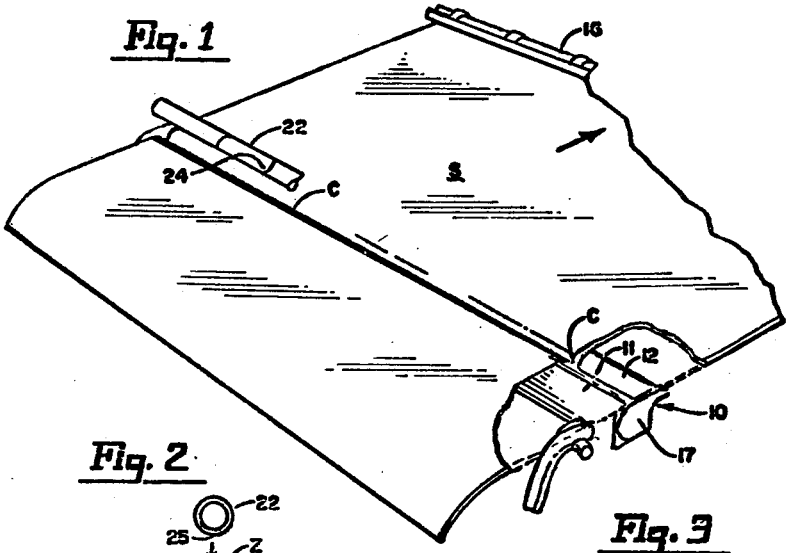
FIG. 1 is a perspective view showing the sheet material, with portions broken away, being pulled by the gripper bar over the decurler unit.
Figure 2:
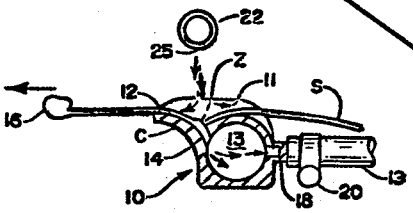
FIG. 2 is a sectional view of the decurler unit taken in a vertical plane in the direction of travel of the sheet material.
Figure 3:
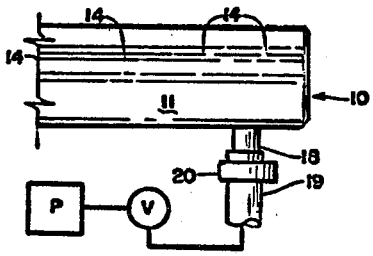
FIG. 3 is a partial top view of the decurler unit with the valve and vacuum pump shown schematically.

The general nature of the apparatus of the present invention may be understood with reference to FIGS. 1–3. With reference first to FIGS. 1 and 2, decurler unit 10 defines a pair of substantially parallel elongated support surfaces 11 and 12 which extend transversely across the entire width of sheet material, S. Decurler unit 10 defines chamber 13 which communicates with ambient conditions in a zone, Z, between support surfaces 11 and 12 by means of ports 14. Chamber 13 and ports 14, together with the vacuum pump, P, shown schematically in FIG. 3, serve as means for creating a pressure gradient in zone, Z, between elongated support surfaces 11 and 12 throughout the length thereof. Gripper bar 16 grips the leading edge of sheet material, S, in the conventional manner, and serves as means for drawing sheet material, S, over support surfaces 11 and 12 through the pressure gradient zone, Z.

The general operation and method of the present invention may also be understood with reference to FIGS. 1–3. With reference primarily to FIG. 1, it may be seen that gripper bars 16 grip the leading edge of sheet material, S, and draw the sheet material over the spaced parallel support surfaces 11 and 12. The pressure gradient in zone, Z, simultaneously and continuously forces sheet material, S, against support surfaces 11 and 12 and into zone, Z, between and offset from support surfaces 11 and 12, thereby cleaning the unprinted or dry side of the material by a vacuum-type action and continuously bending or creasing the sheet material at crease, C. Sheet material, S, is consequently continuously creased transversely of the direction of travel, throughout its length to thereby counteract or compensate for the natural tendency of the material to curl about an axis spaced from and on the unprinted or dry side. This natural tendency to curl is apparent in FIGS. 1 and 2 when viewing the trailing portion of sheet material, S, that is, the portion downstream from decurler unit 10.

The detailed construction of the invention may be understood with reference first to FIGS. 1 and 2. Decurler unit 10 may be typically formed by joining portions of tubular members and providing ports 14 from the vertex of the joined tubular members to the chamber of one member. Thus, with reference to FIG. 2, a pair of parallel support surfaces 11 and 12 are provided and a space is provided between the support surfaces. A pressure gradient is provided in the space by means of a vacuum pump, P, and means for adjusting the pressure represented by valve, V, shown schematically in FIG. 3.

Decurler unit 10 includes end walls 17, shown in FIGS. 1 and 2, which extend above support surfaces 11 and 12 a distance somewhat greater than the thickness of sheet material, S, to form side walls which engage and guide the edge of sheet material, S. The upper portion of end walls 17 serves to minimize leakage at the edges of sheet material, S, thereby increasing the efficiency of the creasing operation. Fitting 18, hose 19 and clamp 20 serve to connect chamber 13 with valve, V, and vacuum pump, P, shown in FIG. 3, which serve as means for evacuating chamber 13, thereby creating a pressure gradient in zone, Z, and means for adjusting the pressure gradient.

Operating under ambient conditions with a printing speed in the range of 4500–6200 sheets of 19 inch width and 25 inch length per hour (or a lineal sheet speed of approximately 150–200 fpm), the pressure in chamber 13 may be maintained in the range of 27½–29 inches of mercury or approximately 13.5–14.2 psia. This pressure range results in a pressure gradient in zone, Z, of about 0.5–1.2 psi. The free air flow in zone, Z, has been found to be in the range of 6.7–17.0 cfm under the above conditions. The foregoing are typical values for a given installation and changes in conditions and design of the decurler unit may call for substantial changes in the above values. Those skilled in the art may choose a vacuum pump and valve of suitable size and capacity for obtaining the requisite pressure gradient and adjustment capabilities.

With reference to FIG. 2, an air blast tube 22 may be provided on the printed side of sheet material, S, to serve as alternate means for creating the requisite pressure gradient, or to serve in combination with decurler unit 10. Ports 23 are directed downwardly into zone, Z, from chamber 24 which is pressurized to exclusively provide or contribute to the pressure gradient in zone, Z. Air blast tube 22 thus serves to urge sheet material, S, downwardly between support surfaces 11 and 12. Air blast tube 22 also serves to dry ink or other coating on sheet material, S, and cleans the material by blowing away clinging particles.

Valve, V, may be adjusted to vary the pressure in chamber 13 to accommodate for various speeds of travel of sheet material, S, and various properties, including thickness, of the sheet material. This adjustment can be made in empirical fashion until the required degree of creasing, bending or decurling is accomplished as sheet material, S, passes over decurler unit 10. The pressure in air blast tube 22 may also be adjusted by those skilled in the art for varying conditions to provide the requisite pressure gradient in combination with decurler unit 10.

Figure 4:
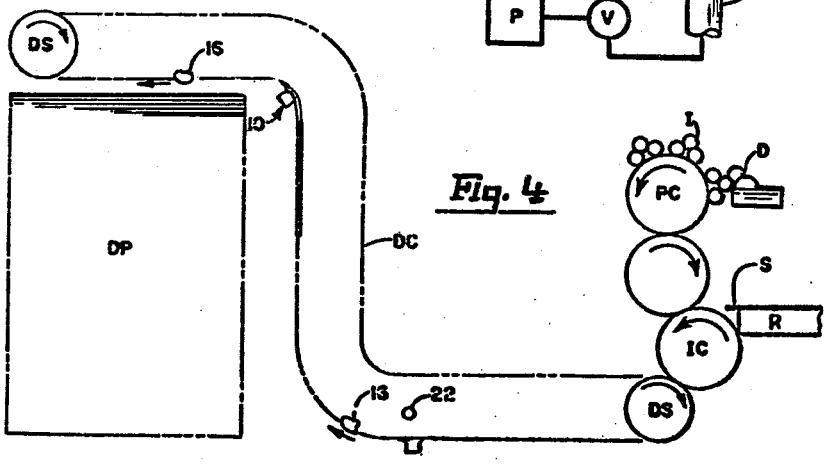
FIG. 4 is a schematic profile view of a typical printing press and shows the various cylinders, the mounting and path of travel of the gripper bars, the path of travel of the sheet material, and the final delivery pile.

Decurler unit 10 can be installed in a number of locations on a printing press extending the full transverse width of sheel material, S, or extending longitudinally (not shown). With reference to FIG. 4, two typical locations are shown in a continuous printing press which includes dampening rollers, D, inking rollers, I, plate cylinder, PC, blanket cylinder, B, impression cylinder, IC, delivery chain sprocket, DS, and delivery chain, DC, on which gripper bars 16 are mounted.

Sheet material, S, is fed from register table, R, between blanket cylinder, B, and impression cylinder, IC, where the printing operation occurs. The material is picked up by gripper bar 16 as it leaves blanket cylinder, B, and impression cylinder, IC, and passes around the lower delivery chain sprocket, DS. As sheet material, S, begins travel along the lower flight of delivery chain, DC, toward delivery pile, DP, the printed or wet side is up, as viewed in FIG. 4, and the sheet material has a natural tendency to curl downwardly as shown in FIGS. 1 and 2. Gripper bar 16 pulls the sheet material toward decurler unit 10, through the pressure gradient zone, where the creasing or decurling operation described above occurs. An alternate location for the decurler unit is in the vicinity of the upper right portion of delivery pile, DP, shown in FIG. 4. Gripper bar 16 releases sheet material, S, prior to beginning its return flight, and the decurled sheet material forms a neat, registered stack at delivery pile, DP.

The use of decurler unit 10 places the forward or downstream portion of sheet material, S, between gripper bar 16 and decurler unit 10, in control under tension. Consequently, other processing or treatment of the sheet material is made feasible by the invention. This may include longitudinally slitting the material by means of a blade edge disposed downstream with respect to decurler unit 10, as well as other operations which require some degree of control of the sheet, not provided by prior art aparatus.

Variations in the design and operation of the preferred embodiment shown and described can be made without departing from the scope of the invention. The specific configuration of decurler unit 10 may vary greatly for ease of fabrication and installation, the only critical design features being the pair of spaced, substantially-parallel support surfaces with a space or pressure gradient zone between them. Thus, the configuration of chamber 13 may vary and chamber 13 need not be formed integrally with support surfaces 11 and 12. A pair of rods could be used for the support surfaces, for example, and distinct means for creating the pressure gradient could be provided in the form of pressure above or on the printed or wet side of the sheet, a vacuum below or on the unprinted or dry side of the sheet, or both.

In the preferred embodiment both pressure greater than ambient pressure above the sheet material, as well as a vacuum (pressure less than ambient pressure) beneath or on the unprinted side of the sheet material is provided. Thus the pressure gradient extends from in excess of ambient pressure above the sheet to less than ambient pressure below the sheet. Pressure along above or a vacuum alone below the sheet could be used to create the pressure gradient, and such a variation would be within the scope of the invention.

Decurler unit 10 may be oriented longitudinally, that is, extending in the direction of travel of sheet material, S, for providing a longitudinal crease which may be desirable in certain situations, for example, in folding the sheet. Thus it should be recognized that decurler unit 10 need not necessarily be oriented transversely with respect to the path of travel; however, such orientation is necessary for the continuous decurling operation.

It should also be recognized that substantial variations in the speed of travel of sheet material, S, thickness and other properties of the sheet material, pressure gradient and specific pressure values may be routinely accommodate and made by those skilled in the art. Changes in pressure can be made in empirical fashion in order to achieve the degree of creasing desired.

Other variations may also be made in the preferred embodiment by those having orginary skill in the art without departing from the scope of the invention, which is defined by the following claims.

I claim as my invention:

1. Apparatus for decurling a sheet of material curled downwardly at its trailing end about an axis extending transversely to the direction in which the material is traveling, comprising: a pair of fixed, elongated support surfaces of arcuate convex shape positioned substantially parallel to each other in spaced apart relation and extending transversely with respect to the path of travel of the sheet to be decurled, and forming a decurling zone between said arcuate support surfaces recessed below the top extremities of said support surfaces, said support surfaces having a length at least as great as the width of said sheet;

means for creating a pressure gradient in said zone between said elongated support surfaces throughout the length thereof sufficient to deform the sheet of material in a direction opposite to the curl in the sheet, said means for creating a pressure gradient comprising a vacuum chamber in fluid flow communication with said decurling zone on the reverse side of said support surfaces from that traversed by a sheet of material, means for evacuating said chamber, and means disposed on the side of the sheet of material opposite the support surfaces for directing a pressurized air stream between the support surfaces into the decurling zone against the sheet material; and pulling means for drawing the sheet of material over said support surfaces and through said zone, whereby the entire sheet will progressively pass through said zone and be decurled, said pulling means positively engaging the sheet and cooperating with said pressure gradient in said decurling zone to hold said sheet in tension therebetween to facilitate the decurling of said sheet.

2. The apparatus of claim 1 wherein the means for directing an air stream against the sheet material includes:

an elongated chamber in a zone between, vertically offset above, and extending substantially parallel to the support surfaces, air discharge openings on the side of said elongated chamber facing said support surfaces extending over substantially the entire length of said decurling zone, directly in line with the center of said zone.

3. The apparatus of claim 2 and means formed integrally with the support surfaces and said vacuum chamber on one end thereof for engaging the side edges of the sheet material.

4. The apparatus of claim 2 wherein said air discharge openings comprise a series of uniformly spaced openings in said elongated chamber for communicating with ambient conditions in the zone.

5. A method for decurling a paper sheet curled at its trailing end about an axis extending transverse to the direction in which the sheet is being conveyed, comprising:

positively engaging the forward end of the sheet by gripping means;

pulling said sheet, by said gripping means, over a pair of closely spaced, substantially parallel, elongated support surfaces extending transversely to the direction of travel of the sheet across the entire width of the sheet;

simultaneously creating a pressure differential across a zone between and offset from said support surfaces sufficient to continuously force said sheet against said support surfaces by directing pressurized air into said zone over substantially the entire length thereof on the side of the sheet opposite the support surfaces and simultaneously drawing a vacuum in said zone on the other side of said sheet to force said sheet into friction contact with said support surfaces and deform it in said zone in a direction opposite to that in which it is curled; and deforming said sheet material into said zone between said support surfaces by operation of said pressure differential in a direction opposite to that in wich the sheet material is curled, and thereby placing said sheet material in tension between said gripping means and said pressure differential zone between said support surfaces and decurling said sheet as it is deformed into said zone under tension.

6. The apparatus of claim 1, and a plurality of holes extending through one of said support surfaces into said vacuum chamber, said holes being spaced apart along the length of said decurling zone at predetermined locations thereon.

* * * * *